US008763514B2

(12) United States Patent
Yaguchi et al.

(10) Patent No.: US 8,763,514 B2
(45) Date of Patent: Jul. 1, 2014

(54) GAS LUBRICATION STRUCTURE FOR PISTON, AND STIRLING ENGINE

(75) Inventors: Hiroshi Yaguchi, Susono (JP); Daisaku Sawada, Gotemba (JP); Masaaki Katayama, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 596 days.

(21) Appl. No.: 13/124,008

(22) PCT Filed: Dec. 1, 2009

(86) PCT No.: PCT/JP2009/070143

§ 371 (c)(1),
(2), (4) Date: Apr. 13, 2011

(87) PCT Pub. No.: WO2010/067728

PCT Pub. Date: Jun. 17, 2010

(65) Prior Publication Data

US 2011/0197755 A1 Aug. 18, 2011

(30) Foreign Application Priority Data

Dec. 10, 2008 (JP) ..... 2008-313949

(51) Int. Cl.
*F02G 1/053* (2006.01)

(52) U.S. Cl.
USPC ..... 92/158; 92/223

(58) Field of Classification Search
USPC ..... 92/86.5, 158, 159, 223; 123/46 SC, 123/193.4; 184/6.8
See application file for complete search history.

(56) References Cited

U.S. PATENT DOCUMENTS

| | | | | |
|---|---|---|---|---|
| 3,127,955 | A * | 4/1964 | Elmer | 184/18 |
| 3,777,722 | A | 12/1973 | Lenger | |
| 4,330,993 | A * | 5/1982 | Beale | 60/520 |
| 4,846,051 | A * | 7/1989 | Wade et al. | 92/127 |
| 2005/0081805 | A1 | 4/2005 | Novotny | |
| 2005/0268604 | A1 * | 12/2005 | Takahashi et al. | 60/517 |

(Continued)

FOREIGN PATENT DOCUMENTS

| | | | |
|---|---|---|---|
| DE | 10 2006 052 447 | A1 | 5/2008 |
| EP | 0 299 785 | A2 | 1/1989 |

(Continued)

OTHER PUBLICATIONS

International Search Report in International Application No. PCT/JP2009/070143; dated Feb. 16, 2010 (with English-language translation).

(Continued)

*Primary Examiner* — Thomas E Lazo
(74) *Attorney, Agent, or Firm* — Oliff PLC

(57) ABSTRACT

A gas lubrication structure is provided with a high-temperature-side cylinder, an expansion piston lubricated relative to the high-temperature-side cylinder by gas, and a layer provided to the outer peripheral surface of the expansion piston and composed of a material flexible and having a higher linear expansion coefficient than the base material of the expansion piston. The thickness of the layer under normal temperatures is not less than the size of the clearance formed between the layer and the high-temperature-side cylinder. Also, even if the layer is thermally expanded under use conditions, the layer under normal temperatures has a thickness enabling a clearance to be formed between the layer and the high-temperature-side cylinder.

8 Claims, 8 Drawing Sheets

(56) References Cited

U.S. PATENT DOCUMENTS

| | | | |
|---|---|---|---|
| 2006/0117947 | A1 | 6/2006 | Tabata et al. |
| 2006/0207249 | A1 | 9/2006 | Yaguchi et al. |
| 2010/0046862 | A1 | 2/2010 | Schubert |

FOREIGN PATENT DOCUMENTS

| | | |
|---|---|---|
| JP | A-61-135967 | 6/1986 |
| JP | A-05-001620 | 1/1993 |
| JP | A-06-093927 | 4/1994 |
| JP | A-2005-106009 | 4/2005 |
| JP | A-2005-520095 | 7/2005 |
| JP | A-2006-161563 | 6/2006 |
| JP | A-2006-183566 | 7/2006 |

OTHER PUBLICATIONS

Apr. 16, 2014 Search Report issued in European Patent Application No. 09831832.2.

* cited by examiner

GAS LUBRICATION STRUCTURE FOR PISTON, AND STIRLING ENGINE

TECHNICAL FIELD

The present invention relates to a gas lubrication structure for a piston and a stirling engine, in particular, to a gas-lubrication structure of a piston, in which gas lubrication is performed between a cylinder and the piston, and a stirling engine including the gas-lubrication structure of a piston.

BACKGROUND ART

Recently, stirling engines with good theoretical efficiency have been increasingly focused on, and its purpose is to recover exhaust heat of internal combustions provided in vehicles such as automobiles, buses, or trucks, or exhaust heat of factories. High thermal efficiency of the stirling engine is expected. Further, the stirling engine can use low-temperature difference alternative energies such as solar heat, geothermal heat, or exhaust heat, because the stirling engine is an external combustion which heats the working fluid from its outside. The stirling engine has an advantage of saving energy. In a case where the stirling engine recovers the exhaust heat of an internal combustion or the like, it is necessary to reduce the friction of sliding portions as much as possible and to improve the efficiency of recovery of the exhaust heat. In contrast, Patent Documents 1 and 2 disclose stirling engines, where friction between a piston and a cylinder is reduced by the provision of a gas bearing therebetween, and where the piston is supported by an approximate straight-line mechanism using a grasshopper mechanism.

Moreover, Patent Documents 3 to 6, considered relative to the present invention, disclose a piston provided with a resin. The techniques disclosed in Patent Documents 3 to 5 are the provision of a resin to reduce the friction between the cylinder and the piston which slidably come into contact with each other. The technique disclosed in Patent Document 6 discloses the provision of a resin functioning as a buffer material.

PRIOR ART DOCUMENTS

Patent Documents

Patent Document 1: Japanese Unexamined Patent Application Publication No. 2006-183566

Patent Document 2: Japanese Unexamined Patent Application Publication No. 2005-106009

Patent Document 3: Japanese Unexamined Patent Application Publication No. S61-135967

Patent Document 4: Japanese Unexamined Patent Application Publication No. 2006-161563

Patent Document 5: Japanese Unexamined Patent Application Publication No. H5-1620

Patent Document 6: Japanese Unexamined Patent Application Publication No. H6-93927

DISCLOSURE OF THE INVENTION

Problems to be Solved by the Invention

Incidentally, in a case where the gas lubrication is performed between the cylinder and the piston, a foreign matter might enter a clearance therebetween. Then, the foreign matter might grow. Specifically, in the stirling engine, a foreign matter, such as a metallic piece remaining within a heat exchanger, might enter the clearance and might grow during the engine operation. When the foreign matter enters the clearance between the cylinder and the piston, the bearing stress is increased by the sliding of the piston through the foreign matter. Thus, the foreign matter becomes adhesive. This might lower the performance.

Additionally, to prevent the entering of foreign matters, it is conceivable that foreign matters are preliminarily removed. However, in the stirling engine, it is difficult to sufficiently remove minute matters, which might enter the clearance, of several tens of micrometers when the gas lubrication is performed, between the cylinder and the piston in advance. Further, even if the foreign matters are removed, minute matters might be peeled off from the heat exchanger having a metallic mesh during the engine operation, thereby making it difficult to deal with such a case.

Therefore, the present invention has been made in view of the above circumstances and has an object to provide a gas lubrication structure for a piston and a stirling engine including the gas-lubrication structure, thereby suppressing a foreign matter from entering a clearance between the piston and a cylinder, suppressing an entering foreign matter from becoming adhesive, and improving the endurance against a foreign matter.

Means for Solving the Problems

To solve the above problem, according to an aspect of the present invention, there is provided a gas lubrication structure for a piston, including: a cylinder; a piston, gas lubrication being performed between the piston and the cylinder; and a layer arranged on an outer peripheral surface of the piston, and made of a flexible material with a linear expansion coefficient larger than that of a base material of the piston.

In the present invention, it is preferable that a thickness of the layer under an ordinary temperature may be equal to or larger than a clearance between the layer and the cylinder.

In the present invention, it is preferable that a thickness of the layer under an ordinary temperature may be set such that a clearance between the layer and the cylinder is generated, even when the layer is subject to heat expansion under a use condition.

In the present invention, it is preferable that the piston may include: a large diameter portion provided with the layer, gas lubrication being performed between the large diameter and the cylinder; and a small diameter portion provided at an upper side of the large diameter portion, and the piston may be provided with a step.

In the present invention, it is preferable that at least of a thickness of the large diameter portion may be thin in the thickness of the piston.

In the present invention, it is preferable that the piston may have a shape of a combination of two circular truncated cones and may include a reinforcement member connecting an upper portion of the piston and a lower portion of the piston, the reinforcement member having a drum shape.

According to another aspect of the present invention, there is a stirling engine includes: the gas lubrication structure for a piston of any one of claims 1 to 6; and an approximate straight-line mechanism being connected with the piston and supporting the piston.

In the present invention, it is preferable that the piston may be a high-temperature side piston.

Effects of the Invention

According to an aspect of the present invention, it is possible to suppress a foreign matter from entering a clearance between the piston and a cylinder, and to suppress an entering foreign matter from becoming adhesive, thereby improving the endurance against a foreign matter.

BEST MODES FOR CARRYING OUT THE INVENTION

First Embodiment

Figure 1:
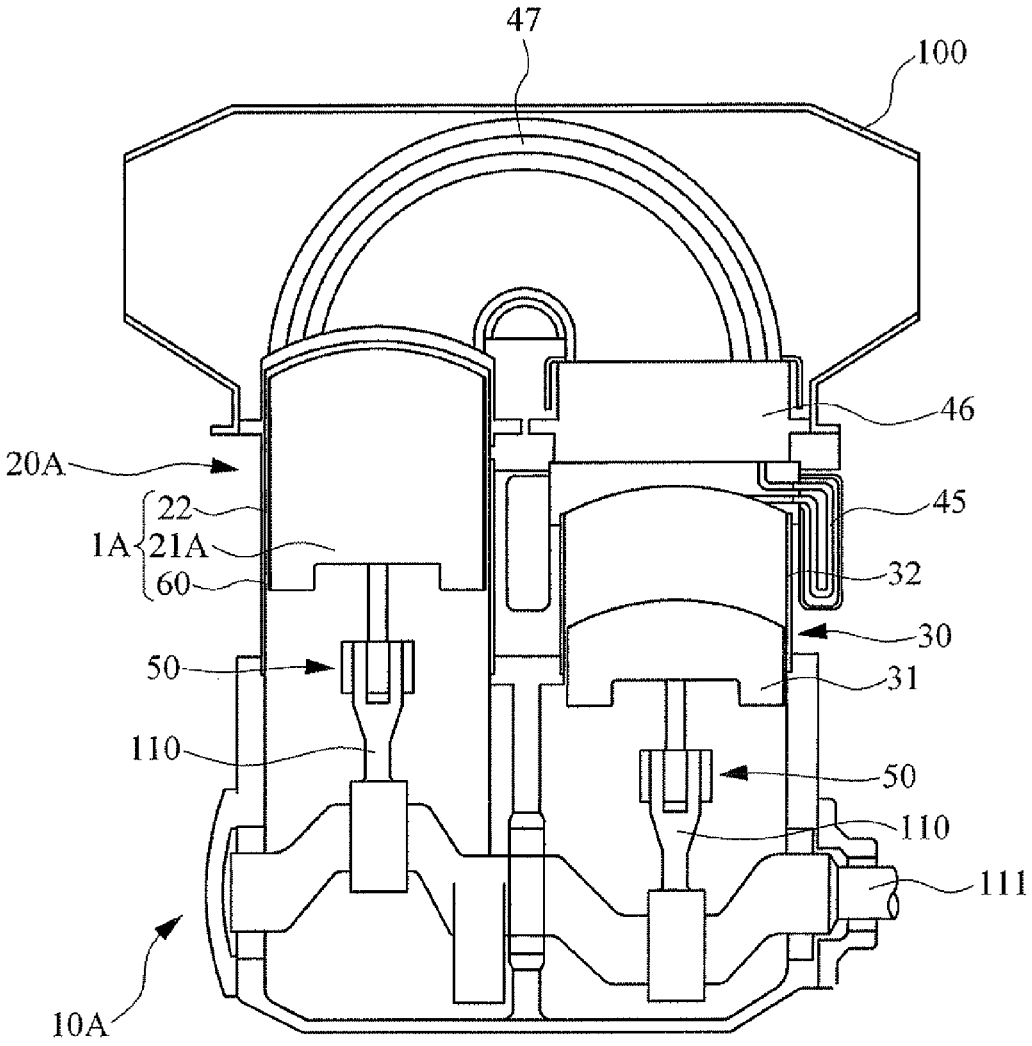
FIG. 1 is a schematic view of a stirling engine 10A.

FIG. 1 is a schematic view of a stirling engine 10A including a gas-lubrication structure for a piston (heareinafter, simply referred to as gas-lubrication structure) 1A. The stirling engine 10A is an $\alpha$ type (two-piston type) of a stirling engine, and includes a high-temperature side column 20A and a low-temperature side column 30 which are linearly and parallel arranged with each other. The high-temperature side column 20A includes an expansion piston 21A and a high-temperature side cylinder 22, and the low-temperature side column 30 includes a compression piston 31 and a low-temperature side cylinder 32. There is a phase difference between the compression piston 31 and the expansion piston 21A such that the compression piston 31 delays in movement against the expansion piston 21A by about 90 degrees of a crank angle.

A space at the upper side of the high-temperature side cylinder 22 is an expansion space. A working fluid heated by a heater 47 flows into the expansion space. In the present embodiment, the heater 47 is arranged within an exhaust pipe 100 of a gasoline engine provided in a vehicle. The working fluid is heated by the heat energy recovered from exhaust gas.

A space at the upper side of the low-temperature side cylinder 32 is a compression space. The working fluid cooled by a cooler 45 flows into the compression space.

A regenerator 46 transmits and receives the heat to and from the working fluid reciprocating between the expansion and compression spaces. Specifically, the regenerator 46 receives the heat from the working fluid when the working fluid flows from the expansion space to the compression space. The regenerator 46 transmits the storage heat to the working fluid when the working fluid flows from the compression space to the expansion space.

Air is employed as the working fluid. However, the working fluid is not limited to air. For example, gas such as He, $H_2$, or $N_2$ is applicable to the working fluid.

Next, the operation of the stirling engine 10A will be described. The working fluid is heated by the heater 47 to expand, so the expansion piston 21A is pressure-moved downwardly and a driving shaft 111 rotates. Next, when the expansion piston 21A is in a process of moving upwardly, the working fluid is transmitted to the regenerator 46 through the heater 47. The working fluid dissipates heat in the regenerator 46 and flows into the cooler 45. The working fluid cooled in the cooler 45 flows into the compression space, and is compressed by the process of upper movement of the compression piston 31. The working fluid, compressed by this way, deprives heat from the regenerator 46 to increase its temperature. The working fluid flows into the heater 47 to be heated and expanded therein. That is, the stirling engine 10A is operated by the reciprocation of the working fluid.

Incidentally, the heat source is exhaust gas of the internal combustion of the vehicle in the present embodiment. For this reason, there is a restriction in the obtainable amount of heat and the stirling engine 10A has to be operated based on the obtainable amount of heat. Thus, the internal friction within the stirling engine 10A is reduced as much as possible in the present embodiment. Specifically, to eliminate the largest frictional loss of a piston ring in the internal friction within the stirling engine 10A, the gas lubrication is performed between the high-temperature side cylinder 22 and the piston 21A, and between the cylinder 32 and the piston 31.

In the gas lubrication, the pistons 21A and 31 are floated in the air by utilizing the air pressure (distribution) generated between the minute clearances between the high-temperature side cylinder 22 and the piston 21A and between the cylinder 32 and the piston 31. The sliding resistance of the gas lubrication is extremely small, thereby substantially reduce the internal friction within the stirling engine 10A. In the gas lubrication where an object is floated in the air, a static pressure gas lubrication is employed in the present embodiment. The static pressure gas lubrication is for ejecting a pressured working fluid and such a generated static pressure flows an object (the pistons 21A and 31 in the present embodiment). In the present embodiment, the pressured working fluid is the working fluid. The working fluid is introduced into the inner side of the expansion piston 21A and is ejected from supply holes (not illustrated) which penetrate through the inner and outer surfaces of the expansion piston 21A. Additionally, the gas lubrication is not limited to the static pressure gas lubrication, and may be a dynamic pressure gas lubrication.

In the preset embodiment, the gas rublication is performed in each of the clearances between the high-temperature side cylinder 22 and the piston 21A and between the cylinder 32 and the piston 31, and each clearance is about several tens of micrometers. The working fluid of the stirling engine is present in the clearances. The pistons 21A and 31 are supported not to contact with the cylinders 22 and 32, or are supported to be in a allowable contact with the cylinders 22 and 32, respectively. Thus, there is no provision of piston rings in the periphery of the pistons 21A and 31. Further, there is no use of lubrication oil which is generally used together with the piston ring. In the gas lubrication, the minute clearance makes each of the expansion and compression spaces to be airproofed, and the clearance is sealed without a ring or oil.

Further, the pistons 21A and 31 and the cylinders 22 and 32 are made of metals. In the present embodiment, specifically, the piston 21A and the cylinder 22 are made of the same metals (herein SUS) having the same linear expansion coefficient, and the piston 31 and the cylinder 32 are made of the same metals (herein SUS) having the same linear expansion coefficient. Thus, even when heat is expanded, the clearance can be suitably maintained to perform the gas lubrication.

Incidentally, the gas lubrication has a small load capability. Therefore, side forces against the pistons 21A and 31 have to be substantial zero. That is, in the case of the gas lubrication, each of the pistons 21A and 31 has a low capability (a pressure-resistant capability) to resist a force in the diameter direction (lateral direction, or thrust direction) of the cylinders 22 and 32. Thus, high accuracy is needed in liner movements of the pistons 21A and 31 with respect to axis lines of the cylinders 22 and 32, respectively.

For this reason, the present embodiment employs grasshopper mechanisms 50, as approximate straight-line mechanisms, arranged between the piston and the clank portion. The approximate straight-line mechanism includes a watt mechanism, for example, in addition to the grasshopper mechanism 50. The grasshopper mechanism 50 has a small size, for requesting the same accuracy in liner motions, than that of another approximate-line mechanism. Thus, the entire size of the device is reduced. Particularly, the stirling engine 10A according to the present embodiment is arranged in a limited space under the floor of the automobile. Thus, a more flexible design is allowed as the device size is reduced. The grasshopper mechanism 50 is lighter, for requesting the same accuracy in liner motions, than that of another approximate-line mechanism. Thus, the grasshopper mechanism 50 has an advantage of mileage. Further, the grasshopper mechanism 50 has an advantage of being configured (produced, or assembled) with ease, because the configuration of the grasshopper mechanism 50 is comparatively simple.

Figure 2:
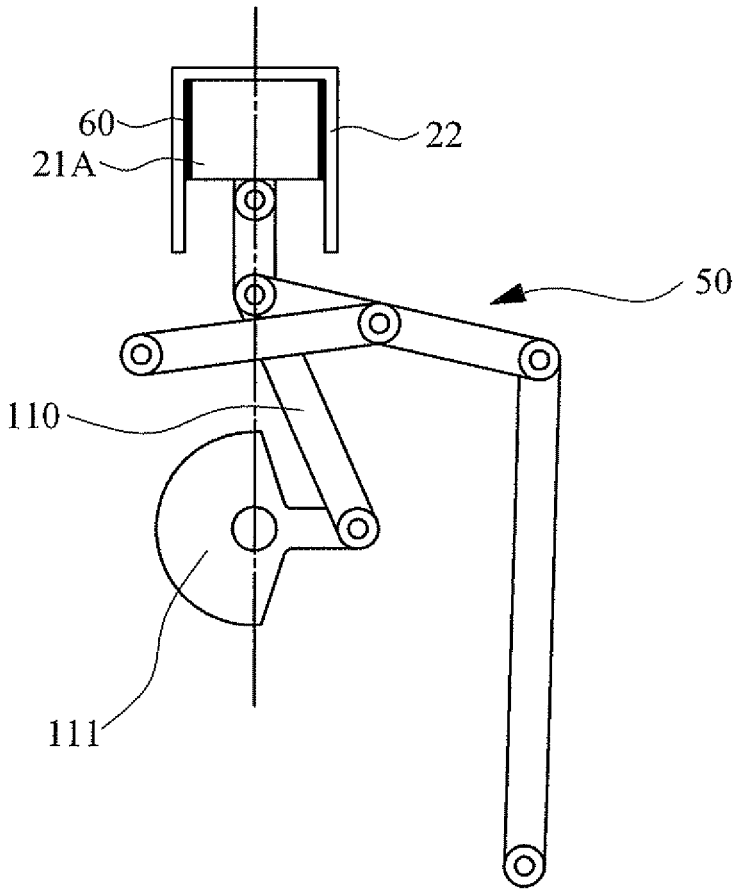
FIG. 2 is a schematic view of a rough configuration of a piston crank portion.

FIG. 2 is a schematic view of a general configuration of a piston crank portion of the stirling engine 10A. Additionally, common components are employed in the piston and crank portions of the high-temperature side column 20A and the low-temperature side column 30A. Thus, hereinafter, only the high-temperature side column 20A will be explained and the explanation of the low-temperature side column 30 is omitted. The reciprocating movement of the expansion piston 21A is transmitted to the driving shaft 111 through a connecting rod 110, and is then converted into the rotational motion. The connecting rod 110 is supported by the grasshopper mechanism 50, and reciprocates the expansion piston 21A linearly. Accordingly, the connecting rod 110 is supported by the grasshopper mechanisms 50, so the side force F against the expansion piston 21A is substantial zero. Therefore, the expansion piston 21A can be suitably supported, even when the gas lubrication with a small load capability is performed.

Incidentally, there might be present the foreign matter such as a minute metallic piece, which cannot be removed at the production time, within a heat exchanger such as the cooler 45, the regenerator 46, or the heater 47. Further, the minute metallic piece might be dropped off, as the foreign matter, from the regenerator 46 including a metallic mesh during the engine operation. During the operation of the stirling engine 10A, the foreign matter might enter the expansion and compression spaces, and might further enter the clearances between the piston 21A and the cylinder 22 and between the piston 31 and the cylinder 32. Thus, the foreign matter might grow to become adhesive. The temperature of the stirling engine 10A becomes high, so it is necessary to consider the influence of the heat expansion and the temperature, and it is difficult to control the clearance. To deal with the adhesion under the high-temperature circumstances, the expansion piston 21A is provided with a layer 60 at its outer surface (for example, a surface facing a wall surface of the high-temperature side cylinder 22). The gas lubrication structure 1A is achieved by the expansion piston 21A, the high-temperature side cylinder 22, and the layer 60. Additionally, it is preferable that the layer 60 according to the present invention is provided at entire outer surface of the expansion piston 21A. However, the layer 60 may be provided at an arbitrary portion of the outer surface of the expansion piston 21A. Further, the layer 60 according to the present invention may be provided at an arbitrary portion of the wall surface of the high-temperature side cylinder 22.

Figures 3A, 3B:
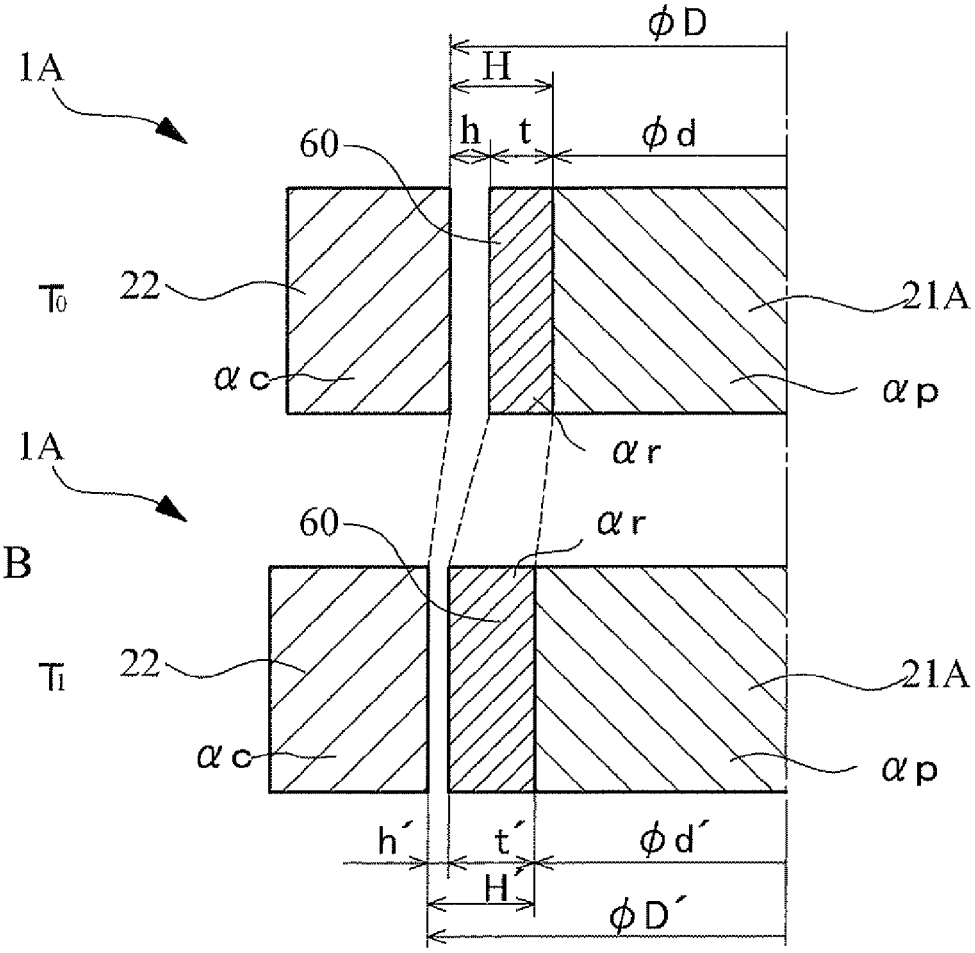
FIGS. 3A and 3B are schematic and enlarged views of the periphery of a radial clearance.

FIG. 3 is a schematic and enlarged view of the periphery of the clearance (hereinafter, referred to as radial clearance) between the high-temperature side cylinder 22 and the expansion piston 21A. Specifically, FIG. 3A illustrates a state before heat expansion (a state at an ordinary temperature $T_0$). FIG. 3B illustrates a state after heat expansion (a state at a maximum temperature $T_1$ used). Here, h represents the radial clearance. H represents a radial clearance between the metallic portions. t represents the thickness of the layer 60. D represents an inner diameter of the high-temperature side cylinder 22. d represents an outer diameter of a base material of the expansion piston 21A. $\alpha c$ represents a linear expansion coefficient of the material of the high-temperature side cylinder 22. $\alpha p$ represents a liner expansion coefficient of the material of the expansion piston 21A. $\alpha r$ represents a liner expansion coefficient of the material of the layer 60. Moreover, ['] means things after heat expansion. Further, the temperature of the working fluid is changeable from ambient temperature (for example, minus 40 Celsius degrees) to several hundreds (for example, 400 Celsius degrees). For example, the ambient temperature $T_0$ is minus 40 Celsius degrees, and the maximum used temperature $T_1$ is 400 Celsius degrees.

The layer 60 is configured to coat a resin. The resin has a linear expansion coefficient larger than one of the base material of the expansion piston 21A ($\alpha_r > \alpha_p$), and has flexibility. In the present embodiment, specifically, the resin is a fluorinated resin. Generally, the liner expansion coefficient of the resin is from about 4 to about 10 times higher than that of a metal. It may be difficult to employ the resin in the outer surface of the expansion piston 21A having the radial clearance being about several tens of micrometers. The liner expansion coefficient of the layer 60 is set such that the clearance between the high-temperature side cylinder 22 and the layer 60 is made smaller as the temperature increases.

The thickness of the layer 60 under the ambient temperature $T_0$ is equal to or more than the radial clearance ($t \geq h$). Specifically, the thickness t of the layer 60 is 50 μm, and the radial clearance h is 20 μm, in the present embodiment. That is, in the present embodiment, the thickness of the layer 60 is equal to or double of the radial clearance. The resin is coated at many times, whereby the thickness of the layer 60 is achieved.

The thickness of the layer 60 under $T_0$ is one such that the clearance between the layer 60 and the high-temperature side cylinder 22 is ensured, even when the heat expansion is generated under use conditions. Specifically, the thickness t of the layer 60 is set within a range determined by a following formula 1.

$$t \leq h/\{(1+4\nu)(\alpha r-\alpha c)\Delta T\} \quad \text{(formula 1)}$$

where ν stands for Poisson ratio, and ΔT stands for a difference between the ordinary temperature T0 and the maximum used temperature T1.

The expansion piston 21A and the high-temperature side cylinder 22 are made of the metals (herein, SUS) having the same linear expansion coefficient ($\alpha p = \alpha c$). For this reason, the radial clearance between the metal portions is not actually changed before or after heat expansion ($H \approx H'$). On the other hand, the thickness of the layer 60, which has the linear expansion coefficient larger than that of the metal, becomes larger after heat expansion ($t < t'$), thereby making the radial clearance smaller after heat expansion ($h > h'$).

On the other hand, a size of a foreign matter which is allowed to enter the radial clearance is basically smaller than the radial clearance h under the ordinary temperature $T_0$, and is exceptionally double as large as the radial clearance (2 h) at a maximum.

Even if the foreign matter enters the clearance between the expansion piston 21A (accurately, the layer 60) and the high-temperature side cylinder 22, such an entered matter is attached to the layer 60 by the flexibility thereof and is caught at the time of, for example, the heat expansion. After that, when the expansion piston 21A (accurately, the layer 60) comes close to the high-temperature side cylinder 22 or comes into contact with the high-temperature side cylinder 22 during the engine operation in a subsequent process, the matter may be buried in the layer 60 having the flexibility. This prevents an increase in the surface pressure caused by the foreign matter, and prevents the adhesion.

Further, even if the entered foreign matters are combined with each other and become larger, the foreign matters can be allowed to enter and grow, until the size of the foreign matters becomes a size of [h+t] determined by adding the radial clearance h to the thickness t of the layer 60.

Moreover, since the layer 60 is made of the fluorinated resin having a function of solid lubricant, the adhesion caused by the layer 60 itself can be prevented.

In this way, the gas lubrication structure 1A and the stifling engine 10A can prevent the adhesion, even when the foreign matter enters the radial clearance or then become larger. This can greatly increase the resistance against the foreign matter.

Additionally, the gas lubrication greatly decreases the internal friction without the sliding friction. Thus, the fluorinated resin having the solid lubricant function is not selected for the purpose of reducing the sliding friction.

Further, a method of determining the formula 1 will be described later.

When the layer 60 is not restrained, the heat expansion t'' in each thickness direction is expressed by the following formula 2.

$$t''=(1+\alpha r\times\Delta T)\times t \quad \text{(formula 2)}$$

However, in fact, the expansions in the circumferential direction and height direction are restricted by the expansion of the base material of the expansion piston 21A. The expansion tp of the base material of the expansion piston 21A is determined by the following formula 3.

$$tp=(1+\alpha c\times\Delta T)\times t \quad \text{(formula 3)}$$

wherein $\alpha c=\alpha p$.

Figure 4A:
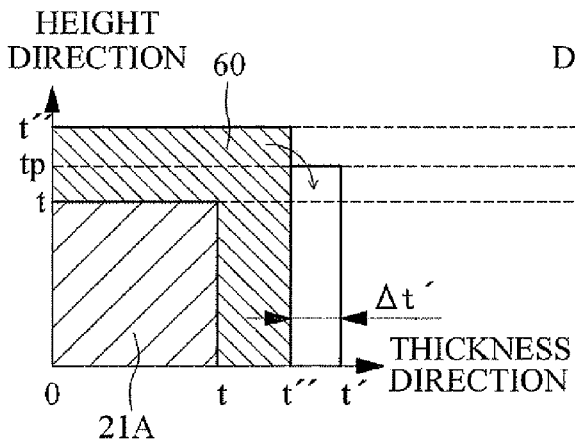
FIGS. 4A and 4B are schematic views of the change of the thickness of a layer 60 by heat expansion.
Figure 4B:
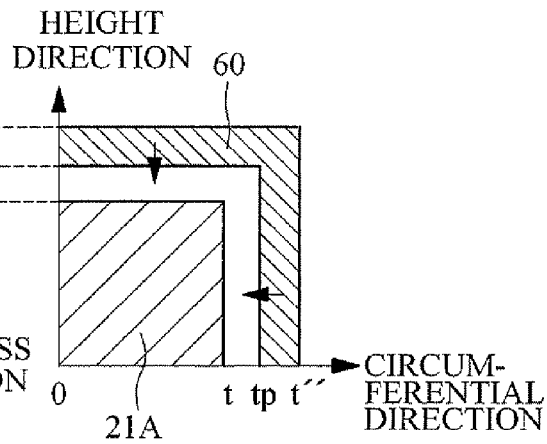

Next, the restricted expansion of the layer 60 will be considered. FIG. 4 is a schematic view of changing of the thickness of the layer 60 by heat expansion. As illustrated in FIG. 4B, the expansion of the layer 60 in the circumferential direction and the height direction are restricted by the base material of the expansion piston 21A. It is considered that the entire heat expansion volume which is restricted is converted into the thickness direction. As a result, it is considered that the layer 60 is further expanded in the thickness direction by Δt' in addition to the heat expansion, as illustrated in FIG. 4A. For this reason, when it is assumed that all volume of the expansion restricted is transformed to the thickness, the amount of change Δt' is determined by the following formula 4.

$$\begin{aligned}\Delta t' &= \{(t''^2 - tp^2)/tp^2\}\times t'' \quad \text{(formula 4)}\\ &= [\{(1+\alpha r\times\Delta T)^2 - (1+\alpha c\times\Delta T)^2\}/(1+\alpha c\times\Delta T)^2]\times t''\end{aligned}$$

On the other hand, the final conclusive thickness t' after heat expansion is expressed by the following formula 5.

$$t'=t'+\Delta t''' \quad \text{(formula 5)}$$

A formula 6 is determined by substituting the formulas 2 and 4 into the formula 5.

$$\begin{aligned}t' &= \{(1+\alpha r\times\Delta T)^2/(1+\alpha c\times\Delta T)^2\}\times t'' \quad \text{(formula 6)}\\ &= \{(1+\alpha r\times\Delta T)^3/(1+\alpha c\times\Delta T)^2\}\times t'\end{aligned}$$

Herein, when it is assumed that the radial clearance h' is equal to or more than zero after heat expansion, the relationship between a radial clearance H' of a metallic portion and the thickness t' after heat expansion is determined by the following formula 7.

$$H'\geq t' \quad \text{(formula 7)}$$

Further, the radial clearance H' of the metallic portion is determined by the following formula 8.

$$H'=(1+\alpha c\times\Delta T)\times H \quad \text{(formula 8)}$$

A formula 9 is determined by substituting the formulas 6 and 8 into the formula 7 and by arranging them.

$$\begin{aligned}H/t &\geq (1+\alpha r\times\Delta T)^3/(1+\alpha c\times\Delta T)^3 \quad \text{(formula 9)}\\ &= [(1+(\alpha r-\alpha c)\times\Delta T/(1+\alpha c\times\Delta T)]^3\\ &\cong 1+3(\alpha r-\alpha c)\times\Delta T/(1+\alpha c\times\Delta T)\end{aligned}$$

Further, the metallic portion radial clearance H is determined by the following formula 10.

$$H=h+t \quad \text{(formula 10)}$$

The formula 9 is arranged by use of the formula 10 to determine a formula 11.

$$t\leq(1+\alpha c\times\Delta T)\times h/\{3(\alpha r-\alpha c)\times\Delta T\}=h/\{3(\alpha r-\alpha c)\times\Delta T\} \quad \text{(formula 11)}$$

Herein, the formula 11 is established when Poisson's ratio ν is 0.5 (for example, water). Thus, Poisson's ratio ν is substituted into the formula 11 to determine the formula 1 for a case of a solid.

$$t\leq h/\{[1+4\nu(\alpha r-\alpha c)\Delta T] \quad \text{formula 1)}$$

Second Embodiment

A stirling engine 10B according to the present embodiment is substantially identical to the stirling engine 10A, except that a gas lubrication structure 1B is included instead of the gas lubrication structure 1A. The gas lubrication structure 1B is substantially identical to the gas lubrication structure 1A, expect that an expansion piston 21B is included instead of the expansion piston 21A. The expansion piston 21B is substantially identical to the expansion piston 21A expect that the expansion piston 21B is made of a different material form the high-temperature side cylinder 22. For this reason, figures of the gas lubrication structure 1B and the stirling engine 10B are omitted in the present embodiment.

Any material may be applicable as far as the linear the expansion coefficient difference between the expansion piston 21B and the high-temperature side cylinder 22 falls within the range where the radial clearance can be generated even when the heat expansion is generated under the use conditions. Specifically, any material may be applicable to the material of the expansion piston 21B as far as the linear expansion coefficient difference $\Delta\alpha$ between the expansion piston 21B and the high-temperature side cylinder 22 is equal to or less than $5\times10^{-6}$(1/k). This value is determined as follows.

Figure 5:
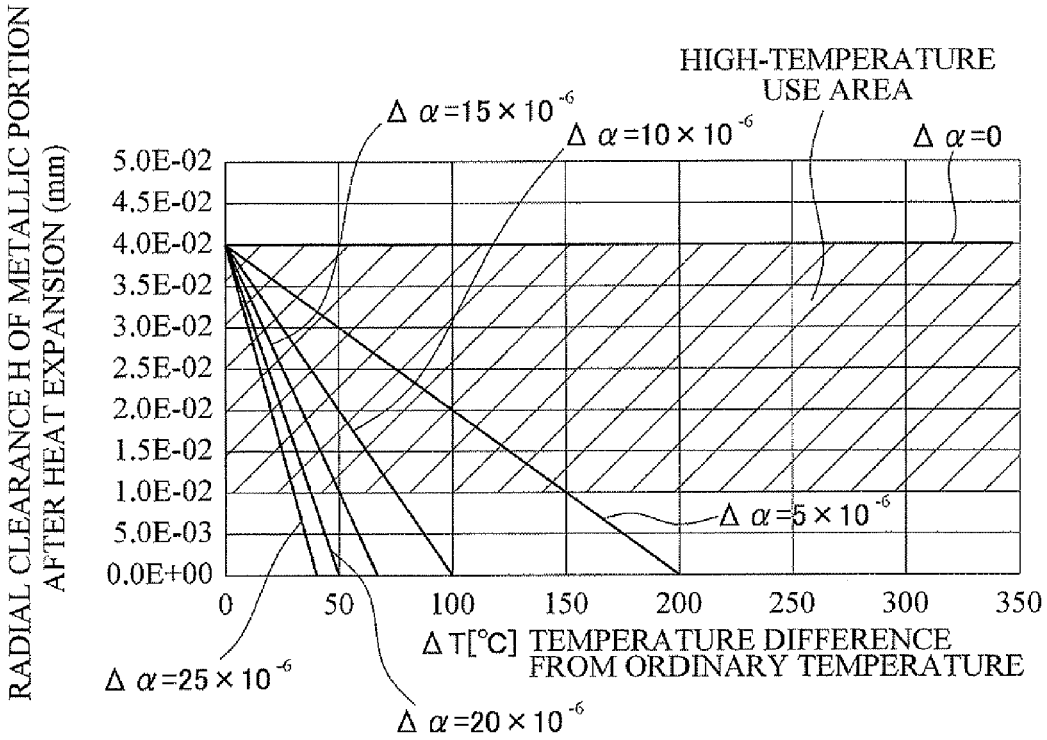
FIG. 5 is a view of a radial clearance H' of a metallic portion after heat expansion, every linear expansion coefficient difference $\Delta\alpha$ in response to a temperature difference $\Delta T$ before and after the heat expansion.

FIG. 5 is a view of the radial clearance H' of the metallic portion with respect to the difference between temperatures before and after the heat expansion every the linear expansion coefficient differences $\Delta\alpha$. Here, in order to calculate a suitable linear expansion coefficient difference $\Delta\alpha$, it is determined that each tolerance of the expansion piston 21B and the high-temperature side cylinder 22 is limited to be equal to or less than 0.005 mm. The metallic portion radial clearance H which needs for the gas lubrication under the ordinary temperature is set equal to or less than d/1000 mm ($H\leq d/1000$). The radial clearance H' of the metallic portion necessary after the heat expansion is set to 0.01 mm ($H'\leq0.01$). Further the smallest diameter of the piston is 40 mm as an applicable piston (d=40). Thus, the initial clearance of the metallic portion is 0.04 mm (H=0.04). The material of the high-temperature side cylinder 22 is SUS. The linear expansion coefficient difference $\Delta\alpha$ is $\Delta\alpha=\alpha c-\alpha p$ and $\alpha c<\alpha p$.

As illustrated in FIG. 5, in view of the above conditions, the high-temperature use range is the range between the initial clearance of the metallic portion being 0.04 mm and the metallic portion clearance necessary after heat expansion being 0.01 mm. In contrast, as compared with the radial clearances of the metallic portion after heat expansion, it is understood that the temperature difference $\Delta t$ becomes larger as the linear expansion coefficient difference $\Delta\alpha$ becomes smaller than $25\times10^{-6}$ mm. However, when the linear expansion coefficient difference $\Delta\alpha$ is $10\times10^{-6}$, the radius clearance of the metallic portion is 0 mm under the condition that the temperature difference $\Delta t$ is 100 Celsius degrees. Therefore, as the high-temperature side range to be used, the temperature difference $\Delta T$ is limited to about 75 Celsius degrees. Incidentally, in the stifling engine 10B, the working fluid with high-temperature about 400 Celsius degrees comes into contact with a top surface of the expansion piston 21B, so that at least the temperature difference $\Delta T$ exceeds 75 Celsius degrees. As a result, a case where the linear expansion coefficient difference $\Delta\alpha$ is $10\times10^{-6}$ is unsuitable.

Meanwhile, when the linear expansion coefficient difference $\Delta\alpha$ is $5\times10^{-6}$, the radial clearance of the metallic portion does not become 0 mm until the temperature difference $\Delta T$ is 200 Celsius degrees. Additionally, it is understood that it is usable until the temperature difference $\Delta T$ is 150 Celsius degrees. In this regard, the maximum use temperature in the periphery of the radial clearance of the metallic portion has to suppressed to a temperature in consideration of the heat resistance of the layer 60 (for example, up to 260 Celsius degrees). When the temperature difference $\Delta T$ is 150 Celsius degrees, the temperature of the layer 60 can be suppressed to be equal to or less than its heat resistance. Further, when the temperature difference $\Delta T$ is 150 Celsius degrees, the maximum use temperature in the periphery of the radial clearance of the metallic portion is suppressed, whereby the temperature difference may be available. Thus, it is preferable that the linear expansion coefficient difference $\Delta\alpha$, should be equal to or less than $5\times10^{-6}$ (1/k).

In this way, the gas lubrication structure 1B and the stirling engine 10B are provided with the expansion piston 21B and the high-temperature side cylinder 22, each of which is made of difference material, and the gas lubrication structure 1B and the stirling engine 10B have the same effects with the gas lubrication structure 1A and the stirling engine 10, even when the materials of the expansion piston 21B and the high-temperature side cylinder 22 are different.

Additionally, the present embodiment has described the stirling engine 10B provided with the expansion piston 21B and the high-temperature side cylinder 22. However, an appropriate material is applicable to the piston and the cylinder according to the present invention.

Third Embodiment

Figure 6:
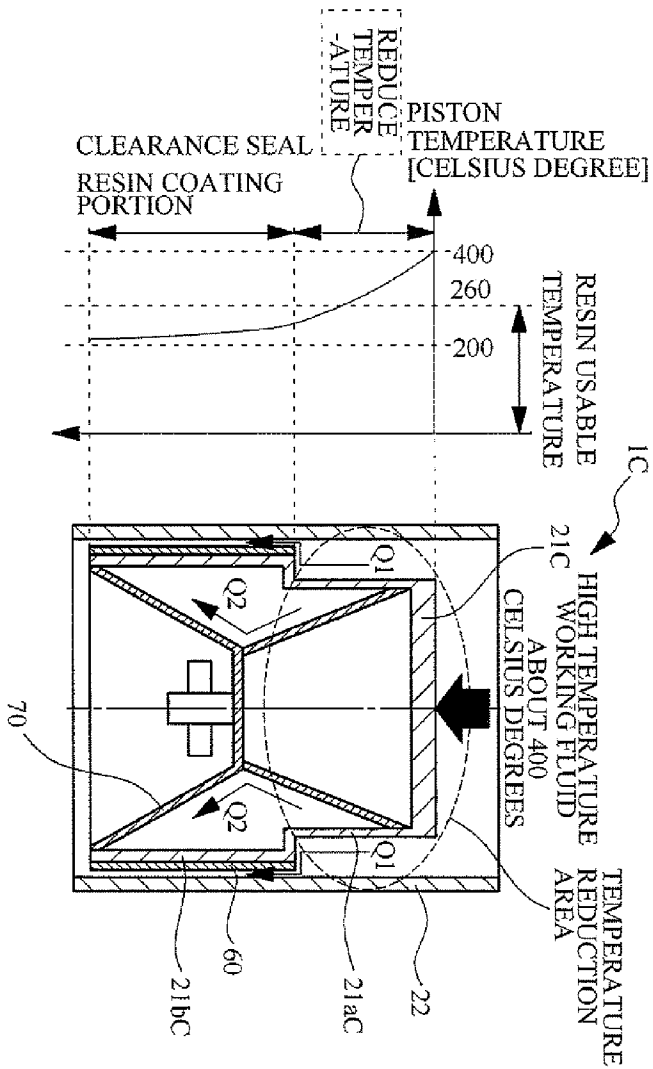
FIG. 6 is a schematic view of a cross section of a gas lubrication structure 1C.

A stirling engine 10C according to the present embodiment is substantially identical to the stirling engine 10A, except that a gas lubrication structure 1C is included instead of the gas lubrication structure 1A. The gas lubrication structure 1C is substantially identical to the gas lubrication structure 1A, except for an expansion piston 21C, instead of the expansion piston 21A. FIG. 6 is a view of a cross section of the gas lubrication structure 1C and a graph of temperature distribution. The expansion piston 21C is provided with a temperature reduction area at its upper portion of the peripheral outer surface, and the temperature reduction area is not provided with the layer 60. In the present embodiment, specifically, the temperature reduction area is a small diameter portion 21*a*C having a diameter smaller than that of a lower portion of the peripheral outer surface (specifically, a skirt portion). Thus, the expansion piston 21C has a step.

The layer 60 is provided at a large diameter portion 21*b*C corresponding to the skirt portion of the expansion piston 21C. In this regard, the layer 60 may be provided in the high-temperature side cylinder 22. In order to suppress the occurrence of adhesion, the layer 60 has to be provided at an entire movable range of the expansion piston 21C. However, in this case, the contact of the layer 60 with the working fluid having high temperature cannot be avoided. For this reason, in the present embodiment, the layer 60 is provided at the large diameter portion 21*b*C of the expansion piston 21C. In the expansion piston 21C, the gas lubrication is performed between the large diameter portion 21*b*C and the high-temperature side cylinder 22.

In the expansion piston 21C, the large diameter portion 21*b*C is made thin. Further, in the expansion piston 21C, the head portion has a top surface and has a hollow cylindrical shape with a bottom, and the temperature reduction area (the small diameter portion 21*a*C) is made be thin. It is preferable to make it as thin as possible. In the present embodiment, the expansion piston 21C is made be thin to such an extent that it is necessary to reinforce it.

In accordance with this, the expansion piston 21C has a shape of combination of two circular truncated cones, and is further provided at its inside with a drum-shaped reinforcement member 70 connecting the upper and lower portions of the expansion piston 21C. The reinforcement member 70 has an upper portion integrally formed with the expansion piston 21C, and a lower portion is welded. The reinforcement member 70 is thin. The temperature reduction area (the small diameter portion 21*a*C), the large diameter portion 2*b*C, and the reinforcement member 70 each have a symmetrical shape with respect to the central axis of the expansion piston 21C.

In the stirling engine 10C, the provision of the temperature reduction area can reduce the heat transfer Q1 transferred from the top surface of the expansion piston 21C to the large diameter portion 21*b*C.

Further, the temperature reduction area is set to the small diameter portion 21*a*C, thereby permitting the heat expansion of the small diameter portion 21*a*C where the metal is exposed. That is, this can prevent the adhesion of the foreign matter in the small diameter portion 21*a*C. Further, this can reduce the length of the temperature reduction area in the axis direction and the size thereof.

Furthermore, the temperature reduction area (the small diameter portion 21*a*C) and the large diameter portion 21*b*C are made thin, thereby reducing the heat transfer Q1. Additionally, this can reduce the length of the temperature reduction area in the axis direction and the size thereof.

The provision of the reinforcement member 70 can ensure the rigidity in accordance with the reduction in the thicknesses of the temperature reduction area (the small diameter portion 2*a*C) and the large diameter portion 21*b*C.

The reinforcement member 70 is made thin, thereby reducing the heat transfer Q2 from the top surface of the expansion piston 21C to the large diameter portion 2*b*C.

As shown in the temperature distribution graph, the piston temperature of the portion (herein, the large diameter portion 21*b*C) provided with the layer 60 can be suppressed to be equal to or less than the upper temperature limit (herein, 260 Celsius degrees). This can reduction the weight and size of the expansion piston 21C.

Moreover, in the stirling engine 10C, the temperature reduction area (the small diameter portion 21*a*C), the large diameter portion 21*b*C, and the reinforcement member 70 each have a symmetrical shape with respect to the central axis of the expansion piston 21C, thereby making uniform the heat deformation of the expansion piston 21C. This can prevent the adverse effect on the gas lubrication caused by the heat deformation.

In such a way, the gas lubrication structure 1C and the stirling engine 10C can further suppress the temperature of the portion provided with the layer 60 to be equal to or less than the upper temperature limit, as compared with the gas lubrication structure 1A and the stirling engine 10A.

While the exemplary embodiments of the present invention have been illustrated in detail, the present invention is not limited to the above-mentioned embodiments, and other embodiments, variations and modifications may be made without departing from the scope of the present invention.

Figure 7:
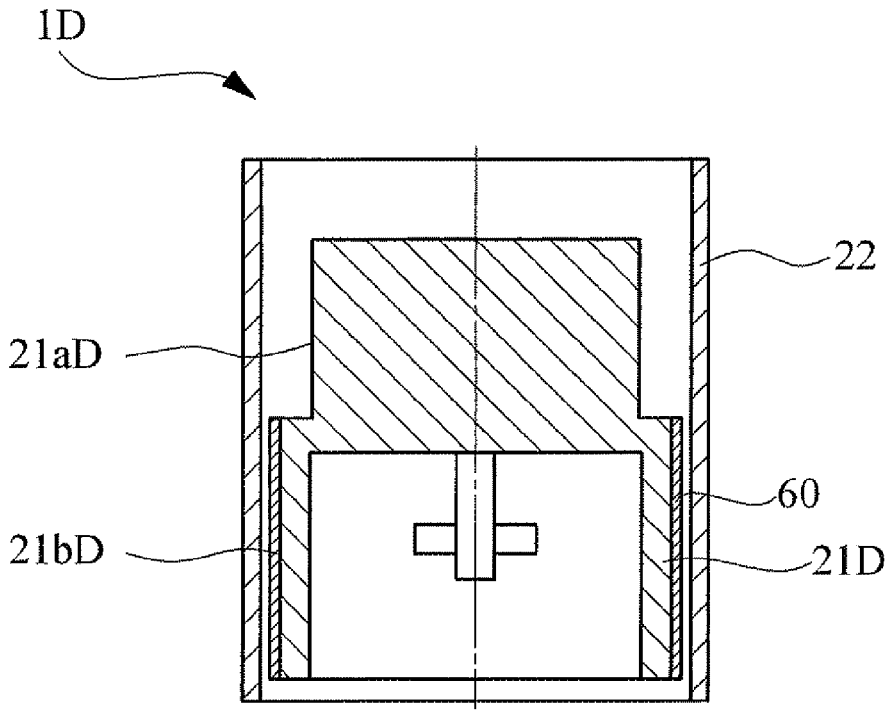
FIG. 7 is a schematic view of a cross section of a gas lubrication structure 1D.
Figure 8:
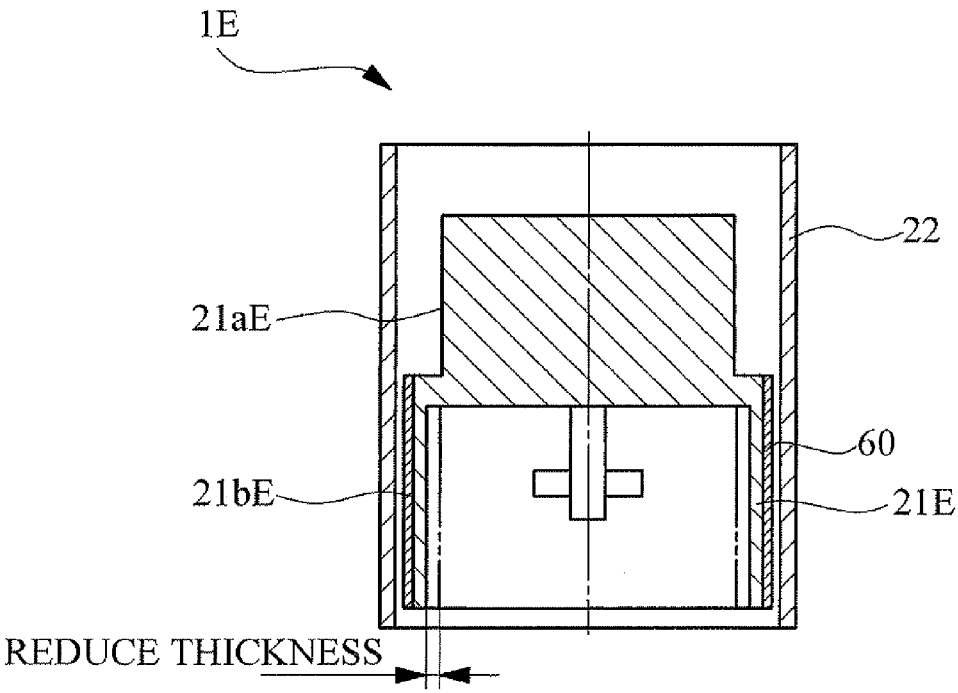
FIG. 8 is a schematic view of a cross section of a gas lubrication structure 1E.

For example, in the third embodiment, the head portion has a top surface of the expansion piston 21C and has a hollow cylindrical shape with a bottom. However, as referring to a gas lubrication structure 1D shown in FIG. 7, the small diameter portion 21*a*D may be provided with a head portion that does not have a hollow shape, especially. Further, as referring to a gas lubrication structure 1E, the small diameter portion 21*b*E may be made thin.

Further, the above embodiments have described the stirling engine 10 in which the layer 60 is provided in the expansion piston 21. However, in the present invention recited in claim 7, a layer may be provided in a compression piston that is a low-temperature side piston.

Moreover, the gas-lubrication structure according to the present invention is suitable for the stirling engine. However, it is not limited to the stirling engine. The stirling engine according to the present invention is not limited to a type which is attached to an exhaust pipe of an internal combustion of a vehicle.

| DESCRIPTION OF LETTERS OR NUMERALS | |
|---|---|
| 1 | gas lubrication structure |
| 10 | starling engine |

-continued

| DESCRIPTION OF LETTERS OR NUMERALS | |
|---|---|
| 20 | high-temperature side column |
| 21 | expansion piston |
| 22 | high-temperature side cylinder |
| 30 | low-temperature side column |
| 45 | cooler |
| 46 | regenerator |
| 47 | heater |
| 50 | grasshopper mechanism |
| 60 | layer |
| 70 | reinforcement member |
| 100 | exhaust pipe |
| 110 | connecting rod |
| 111 | driving shaft |

The invention claimed is:

1. A gas lubrication structure for a piston, comprising:

a cylinder;

a piston, gas lubrication being performed between the piston and the cylinder; and a layer arranged on an outer peripheral surface of the piston, and made of a flexible material with a linear expansion coefficient larger than that of a base material of the piston.

2. The gas lubrication structure for the piston of claim 1, wherein a thickness of the layer under an ordinary temperature is equal to or larger than a clearance between the layer and the cylinder.

3. The gas lubrication structure for the piston of claim 1, wherein a thickness of the layer under an ordinary temperature is set such that a clearance between the layer and the cylinder is generated, even when the layer is subject to heat expansion under a use condition.

4. The gas lubrication structure for the piston of claim 1, wherein the piston includes: a large diameter portion provided with the layer, gas lubrication being performed between the large diameter and the cylinder; and a small diameter portion provided at an upper side of the large diameter portion, and the piston is provided with a step.

5. The gas lubrication structure for the piston of claim 4, wherein at least of a thickness of the large diameter portion is thin in the thickness of the piston.

6. The gas lubrication structure for the piston of claim 4, wherein the piston has a shape of a combination of two circular truncated cones and includes a reinforcement member connecting an upper portion of the piston and a lower portion of the piston, the reinforcement member having a drum shape.

7. A stirling engine comprising:

a gas lubrication structure for a piston, comprising:

a cylinder;

a piston, gas lubrication being performed between the piston and the cylinder; and a layer arranged on an outer peripheral surface of the piston, and made of flexible material with a linear expansion coefficient larger than that of a base material of the piston, and an approximate straight-line mechanism being connected with the piston and supporting the piston.

8. The stirling engine of claim 7, wherein the piston is a high-temperature side piston.

* * * * *